US009427793B2

(12) United States Patent
Toga et al.

(10) Patent No.: US 9,427,793 B2
(45) Date of Patent: Aug. 30, 2016

(54) HOT UPSET FORGING METHOD

(71) Applicant: HITACHI METALS, LTD., Minato-ku, Tokyo (JP)

(72) Inventors: Takashi Toga, Yasugi (JP); Hideki Matsumoto, Yasugi (JP); Yusuke Shigihara, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 24 days.

(21) Appl. No.: 14/372,753

(22) PCT Filed: Jan. 23, 2013

(86) PCT No.: PCT/JP2013/051269
§ 371 (c)(1),
(2) Date: Jul. 17, 2014

(87) PCT Pub. No.: WO2013/111768
PCT Pub. Date: Aug. 1, 2013

(65) Prior Publication Data

US 2014/0373593 A1 Dec. 25, 2014

(30) Foreign Application Priority Data

Jan. 23, 2012 (JP) ..... 2012-010898

(51) Int. Cl.
*B21J 5/08* (2006.01)
*B21J 5/02* (2006.01)
(Continued)

(52) U.S. Cl.
CPC .. *B21J 5/08* (2013.01); *B21J 1/04* (2013.01); *B21J 5/02* (2013.01); *B21J 5/025* (2013.01); *B21J 13/02* (2013.01); *B21J 9/06* (2013.01)

(58) Field of Classification Search
CPC ..... B21J 5/08; B21J 5/02; B21J 1/04; B21J 13/02; B21J 15/025; B21J 19/00; B21J 19/02; B21J 19/06; B21J 15/00; B21J 1/00; B21J 1/02; B21J 9/00; B21J 9/02; B21J 9/06; B21J 5/00; B21J 5/025
USPC ..... 72/377, 352, 267
See application file for complete search history.

(56) References Cited

U.S. PATENT DOCUMENTS 3,650,163 A * 3/1972 Juffs ..... 72/377
5,475,999 A * 12/1995 Sekiguchi et al. ..... 72/259
(Continued)

FOREIGN PATENT DOCUMENTS

CN 1830596 9/2006
JP H07-171650 A 7/1995
(Continued)

OTHER PUBLICATIONS

Office action dated Mar. 26, 2015, from the SIPO in a Chinese patent application corresponding to the instant patent application and the Partial English translation.

*Primary Examiner* — Edward Tolan
*Assistant Examiner* — Mohammad Yusuf
(74) *Attorney, Agent, or Firm* — SOLARIS Intellectual Property Group, PLLC

(57) ABSTRACT

Provided is a hot upset forging method enabling high shape precision to be obtained. The hot upset forging method includes inserting a workpiece (1), with a bottom face diameter d and a height h satisfying h/d>3, into an insertion hole provided passing through a mold (2) of a height H disposed on an anvil (4), and increasing the diameter of the workpiece (1) while decreasing the height of the workpiece (1) to form a forged material. The mold satisfies the following relationships (1) to (3). (1) A shape of the insertion hole and the cross-sectional shape of the workpiece are substantially similar shapes. (2) The height h of the workpiece (1)≤the height H of the mold (2). (3) A largest diameter dl of the workpiece 1, and the maximum inner diameter D of the insertion hole, in the height range of the workpiece (1), satisfy dl<D≤dl×1.5.

2 Claims, 4 Drawing Sheets

(51) Int. Cl.

| | |
|---|---|
| ***B21J 13/02*** | (2006.01) |
| ***B21J 1/04*** | (2006.01) |
| *B21J 9/06* | (2006.01) |

(56) References Cited

U.S. PATENT DOCUMENTS

| | | | |
|---|---|---|---|
| 2006/0090535 | A1 | 5/2006 | Bergue et al. |
| 2010/0101085 | A1 | 4/2010 | Miura |
| 2010/0227695 | A1* | 9/2010 | Suzuki ..... B21J 13/025 464/141 |

FOREIGN PATENT DOCUMENTS

| | | | |
|---|---|---|---|
| JP | 2006-123007 | A | 5/2006 |
| JP | 2006-142332 | A | 6/2006 |
| JP | 2011-177785 | A | 9/2011 |
| TW | 201143930 | | 12/2011 |
| WO | 2009/004738 | A1 | 1/2009 |

* cited by examiner

HOT UPSET FORGING METHOD

TECHNICAL FIELD

The present invention relates to a hot upset forging method.

BACKGROUND ART

Forged products are often employed in members of, for example, steam turbines and aircraft. The size of such products has been increasing in recent years. A large amount of plastic deformation has to be imparted to produce such forged products, necessitating upsetting of elongated material. For example, in the hot upset forging method disclosed in Japanese Patent Application Laid-Open (JP-A) No. H07-171650 (see Patent Document 1), for elongated material with an axial length (equivalent to height in upset forging)/bottom face diameter exceeding 3, for which there would normally be concerns regarding buckling, such issues are resolved by partially employing a specific mold.

Specifically, the hot upset forging method disclosed has the following features:

(1) deformation of an axial direction portion of shaft shaped material toward the outer side in the radial direction is blocked by the mold, such that the ratio of axial length/diameter of a free deformation portion is 3 or less; and (2) forging is started in the state described in (1), and the free deformation portion, other than the deformation-blocked portion of the material, is made to undergo plastic deformation so as to bulge out toward the outer side in the radial direction.

PATENT DOCUMENTS

Patent Document 1: JP-A No. H07-171650

SUMMARY OF INVENTION

Technical Problem

In the above method, described in Patent Document 1, a mold with a height lower than that of the workpiece is employed, and forging is performed such that a portion of the workpiece at the height of the mold and above is the free deformation portion. The method described in Patent Document 1 is an effective method for material for which buckling is a concern. However, there are demands to further increase the shape precision during forging in hot upset forging.

In consideration of such demands, an object of the present invention is to provide a hot upset forging method capable of obtaining a high shape precision.

Solution to Problem

The present invention is a hot upset forging method including inserting a workpiece, with a bottom face diameter d and a height h satisfying h/d>3, into an insertion hole provided passing through a mold of a height H disposed on an anvil, and increasing a diameter of the workpiece while decreasing the height of the workpiece to form a forged material, wherein the mold satisfies the following relationships (1) to (3):

(1) a shape of the insertion hole and a cross-sectional shape of the workpiece are substantially similar shapes;

(2) the height h of the workpiece≤the height H of the mold; and (3) a largest diameter dl of the workpiece, and a maximum inner diameter D of the insertion hole, in a height range of the workpiece, satisfy $dl<D\leq dl\times 1.5$ The invention is a hot upset forging method in which, after the mold is replaced with another mold that satisfies the relationships (1) to (3), hot upset forging is performed a further n times, where n is an integer of 1 or more, using the forged material obtained above as a new workpiece, to obtain a final forged material with a bottom face diameter df and a height hf satisfying $hf/df\leq 3$.

The invention preferably employs a mold that has a tapered portion with increasing diameter in a height direction of 3° or less formed at the insertion hole provided at the mold.

It is further preferable that the hot upset forging method includes a chamfered portion formed at from 5 mm to 30 mm from an end portion of the bottom face of the workpiece.

Advantageous Effects of Invention

The hot upset forging method of the invention enables abnormal deformation to be prevented along the entire length of a workpiece by a specific insertion hole provided to the mold, thereby enabling high shape precision.

DESCRIPTION OF EMBODIMENTS

Figure 1:
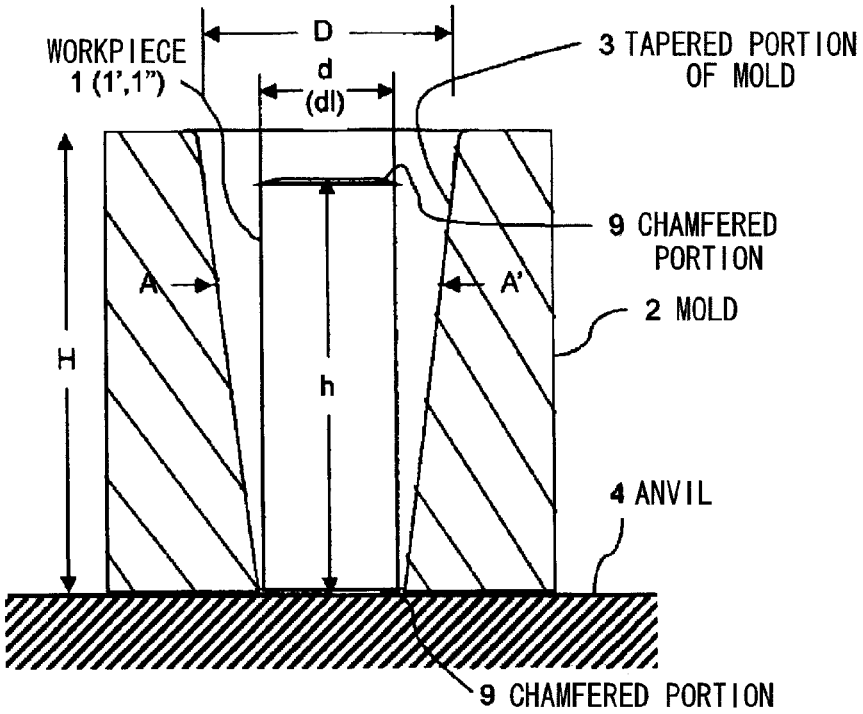
FIG. 1 is a schematic view illustrating an example of a workpiece when inserted into a mold.

The present invention relates to hot upset forging of the entire length of a workpiece using a specific mold, with a bottom face diameter d and a height h of the workpiece satisfying h/d exceeding 3.

Explanation of the invention follows, with reference to the drawings.

Examples of states in which a workpiece is inserted into an insertion hole provided to a mold of the invention are illustrated in FIG. 1 to FIG. 4.

In each of the drawings, a workpiece 1, as described above, is inserted into an insertion hole that is provided passing through a mold 2 of height H set on an anvil 4. The workpiece 1 in each of the drawings is pre-heated to a hot-working temperature region, then inserted into the insertion hole, and hot upset forging is performed to decrease the height h of the workpiece 1 while increasing the diameter thereof using an upper anvil, not shown in the drawings.

Note that the workpiece contacting face of the upper anvil is set larger than the upper face surface area of the workpiece and smaller than the insertion hole diameter of the mold, so as to enable upset forging.

Explanation follows regarding the most relevant relationships between the mold and the workpiece in the invention. The mold employed in the invention has the following three features.

(1) Shape of Insertion Hole and Cross-Sectional Shape of Workpiece are Substantially Similar Shapes The shape of the insertion hole provided to the mold employed in the invention is substantially similar to the cross-sectional shape of the workpiece, namely, is a shape resembling the cross-sectional shape of the workpiece. Configuration with a substantially similar shape enables adjustment to a shape substantially similar in shape to the shape prior to hot upset forging when the workpiece contacts the insertion hole of the mold due to increase of the cross-sectional shape of the workpiece by hot upset forging.

The cross-sectional shape of the workpiece in the invention refers, for example, to the cross-sectional shape in direction A-A' illustrated in FIG. 1. In the case of a circular column shaped workpiece, for example, the shape of the insertion hole is also prepared as a circular shaped hole. In the case of a square column shaped workpiece, for example, the shape of the insertion hole may be formed as a square shaped hole corresponding to that shape. In such a case, the corners of the formed insertion hole may be rounded.

In the case of a polygonal shaped column that has five sides or more, for example, the insertion hole may be a circular shaped hole. Generally speaking, for example, a mold formed with a square shaped hole may be employed for a square column shaped workpiece, and a mold formed with a circular shaped hole may be employed for workpieces of other shapes. In this manner, a shape resembling the shape of the workpiece may be regarded as being of substantially similar shape.

(2) Height h of Workpiece≤Height H Mold

In the invention, setting the height h of the workpiece 1 at the height H of the mold 2 or less enables upset forging of the workpiece to be performed inside the insertion hole. Deformation of the compressed workpiece can accordingly be suppressed in the restricted space of the insertion hole, thereby facilitating control of the shape after hot upset forging. Moreover, when the material to be forged has the same shape and weight, it is possible to obtain, after hot upset forging, the forged material having practically identical shapes with high reproducibility.

(3) Largest Diameter dl of Workpiece, and Maximum Inner Diameter D of Insertion Hole, in Height Range of Workpiece, Satisfy $dl<D\leq dl\times1.5$ In the invention, satisfying the relationship $dl<D\leq dl\times1.5$ prevents the workpiece 1 from buckling inside the insertion hole. In order to more reliably prevent buckling, the relationship $dl<D\leq dl\times1.3$ is preferable, and $dl<D\leq dl\times1.1$ is still more preferable.

The workpiece may be disposed at the center of the insertion hole provided to the mold. This is because shape precision sometimes deteriorates when the setting position of the workpiece is a position inside the insertion hole that is greatly distanced from the center.

Note that in the invention, the largest diameter dl of the workpiece, and the maximum inner diameter D of the insertion hole, in the height range of the workpiece, are taken as references for dimension determination. This is because the largest diameter dl of the workpiece can be used as a typical reference when determining the size of a insertion hole of a mold, the inner diameter of the insertion hole in the height range of the workpiece is a range in which buckling of the workpiece should be suppressed, and buckling can be suppressed by restricting the maximum inner diameter to a specific value or less.

Explanation follows regarding FIG. 1 to FIG. 4.

FIG. 1 illustrates an example in which the applied workpiece has a uniform diameter from a lowermost face contacting the anvil 4 to an uppermost face. Typical examples of such workpieces include vacuum arc remelted ingots, or electroslag remelted ingots, employing water-cooled molds and lathe-turned, and workpieces formed into a circular column shape by cogging, and lathe-turning if required. A tapered portion, increasing in diameter along the height direction, is formed at the insertion hole of the mold 2 in FIG. 1. Formation of the tapered portion is effective from the perspective of facilitating removal of the forged product from the mold after hot upset forging. Note that in FIG. 1, the largest diameter dl of the workpiece is the diameter d of the workpiece, and the maximum inner diameter D of the insertion hole, in the height range of the workpiece, is the diameter at a position corresponding to the uppermost portion of the workpiece.

Figure 2:
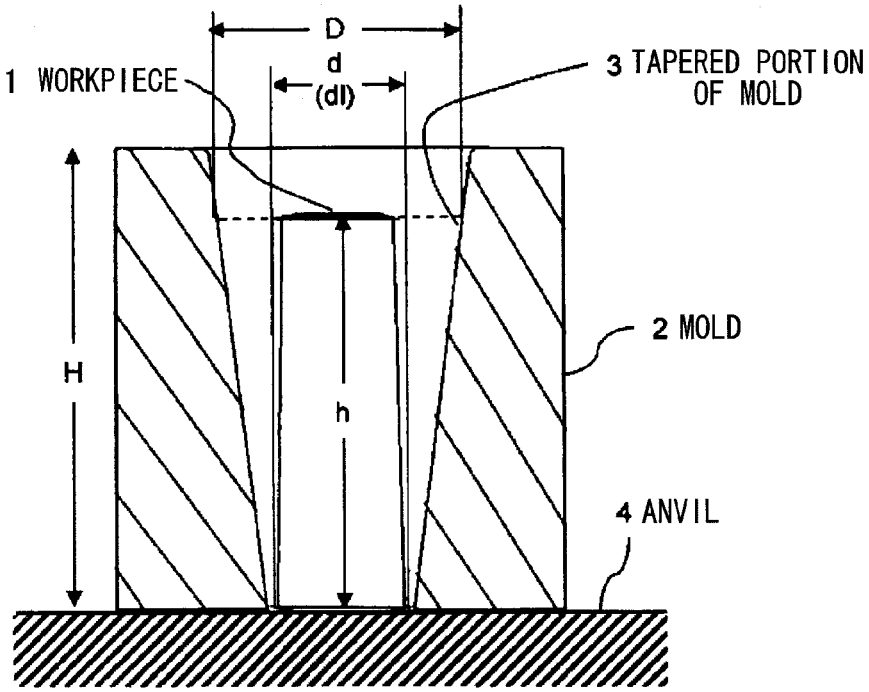
FIG. 2 is a schematic view illustrating another example of a workpiece when inserted into a mold.

FIG. 2 illustrates an example in which the diameter of the applied workpiece decreases from the lowermost face contacting the anvil 4 on progression toward the uppermost face, in what is referred to as a tapered shape, and the insertion hole shape of the mold 2 is the same as in FIG. 1. Note that the largest diameter dl of the workpiece in FIG. 2 is at the position of the lowermost face of the workpiece, and the maximum inner diameter D of the insertion hole, in the height range of the workpiece, is the diameter at the position corresponding to the uppermost portion of the workpiece.

Figure 3:
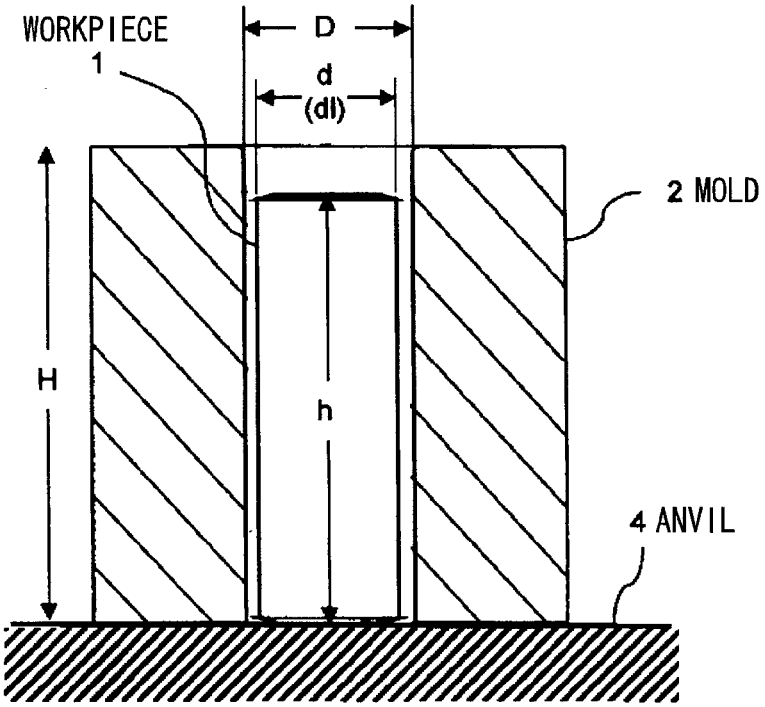
FIG. 3 is a schematic view illustrating another example of a workpiece when inserted into a mold.

FIG. 3 illustrates an example in which the applied workpiece is the same as that in FIG. 1, and in which the insertion hole of the mold has a straight shape, namely, has the same diameter from the lowermost face to the uppermost face. Putting aside consideration of ease of removal of the material to be forged, this mold enables the forged material closest to a circular column shape to be obtained. Note that in FIG. 3, the largest diameter dl of the workpiece is the diameter d of the workpiece, and the maximum inner diameter D of the insertion hole, in the height range of the workpiece, is the diameter of the insertion hole of the mold.

Figure 4:
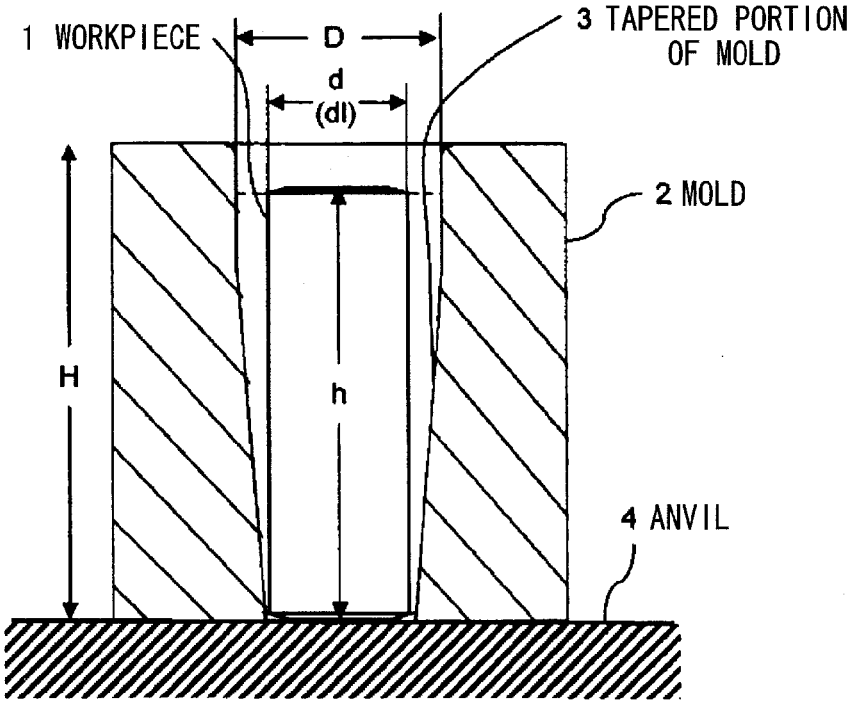
FIG. 4 is a schematic view illustrating another example of a workpiece when inserted into a mold.

FIG. 4 illustrates an example in which the applied workpiece is the same as that in FIG. 1, and the insertion hole of the mold is provided with a tapered portion that increases in diameter from the lowermost face to a specific position, and with an upper portion that is straight, namely, that has a uniform diameter. This shape is effective in cases in which the diameter of the insertion hole of the mold would become too large were a tapered portion to be provided over the entire range. Note that in FIG. 4, the largest diameter dl of the workpiece is the diameter d of the workpiece, and the maximum inner diameter D of the insertion hole, in the height range of the workpiece, is the diameter of straight portion of the insertion hall.

Taking the forged material obtained in the hot upset forging described above as a new workpiece, a final forged material can be formed with a bottom face diameter df and a height hf that satisfy $hf/df\leq3$. In such cases, after the mold is replaced with another mold that satisfies the relationships (1) to (3) above, hot upset forging may be performed a further n times, where n is an integer of 1 or more.

Since the shape and dimensions of the forged material obtained by hot upset forging differ to those prior to working, the mold is replaced and hot upset forging is performed until hf/df≤3 is satisfied. When doing so, re-heating may be performed in cases in which problem arises in hot-workability due to a drop in the temperature of the workpiece.

Figure 5:
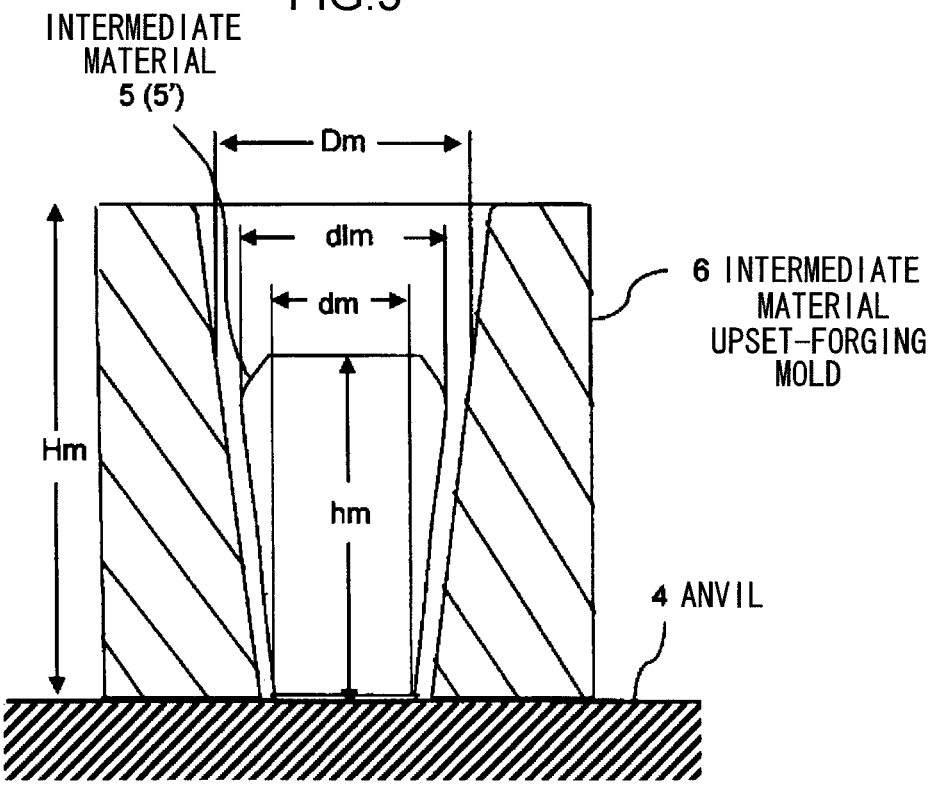
FIG. 5 is a schematic view illustrating an example of an intermediate product when inserted into a mold.

In cases in which hot upset forging is performed a second or further time, particular attention should be given to the position to determine the largest diameter dlm of the workpiece. For example, when hot upset forging is performed in the state illustrated in FIG. 1, an intermediate material 5 of increased diameter is formed with an upper portion substantially following the shape of the mold 2. The intermediate member 5, that has a bottom face diameter dm and a height hm, can then be subjected to further forging using an intermediate material upset-forging mold 6 having a configuration as illustrated in FIG. 5.

When doing so, the largest diameter dlm of the workpiece 1 is at the position of the increased diameter portion, and when the maximum inner diameter of the intermediate material upset-forging mold 6 is denoted Dm, the relationship dlm<Dm≤dlm×1.5 needs to be satisfied. Meanwhile, in FIG. 2, the maximum inner diameter d is the diameter at the position corresponding to the lowermost portion of the workpiece.

Performing a second time or further time of hot upset forging according to the invention one or more times enables a final forged material to be obtained while more reliably suppressing buckling.

An angle of 3° or less is desirable in cases in which a taper is formed at the insertion hole of the mold in the invention as described above. This is because the deformation inside the insertion hole increases when the tapered angle exceeds 3°.

Figure 7:
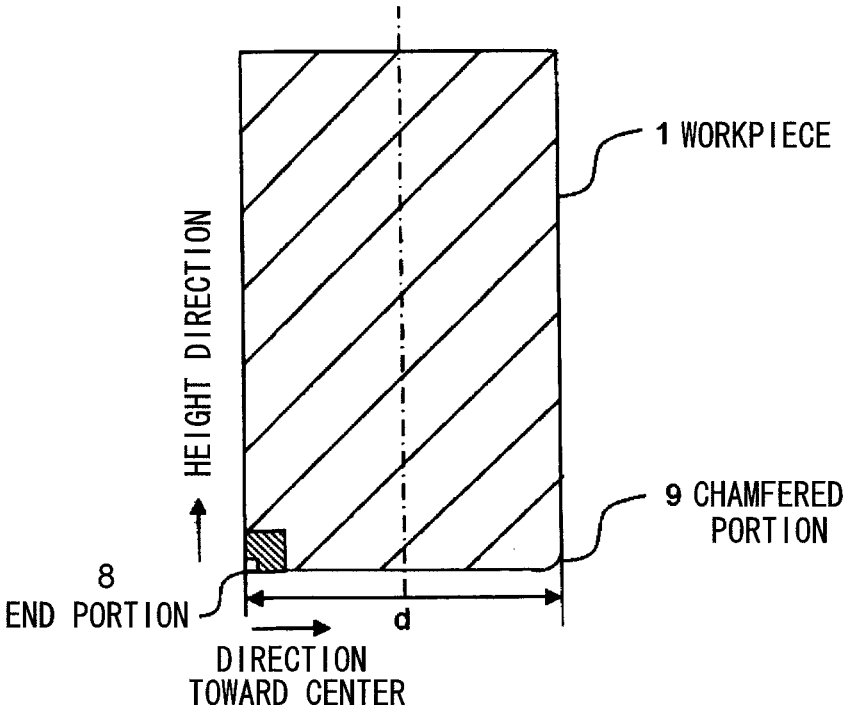
FIG. 7 is a schematic view illustrating an example of a chamfered portion of a workpiece.

In the invention, for example as illustrated in FIG. 7 (a cross-section schematic view of a workpiece), a chamfered portion 9 is preferably formed from 5 mm to 30 mm from an end portion 8 of the workpiece 1 bottom face. Note that in the invention, when the chamfered portion 9 is formed, as illustrated in FIG. 7, the diameter d of the bottom face does not include the chamfered portion 9. Likewise, the bottom face diameter of the intermediate material does not include the chamfered portion.

In the invention, from 5 mm to 30 mm from an end portion 8 of the workpiece 1 bottom face refers to a region (the lines slanting down to the right in FIG. 7) of from 5 mm to 30 mm toward the center of the workpiece from the end portion 8, and a region of from 5 mm to 30 mm toward the height direction from the end portion 8. The chamfered portion 9 may be chamfered to a curved line as illustrated in FIG. 7, or may be chamfered to a straight line. The chamfering method may be performed employing a lathe, a grinder, or the like.

Note that the chamfered portion is preferably formed such that the surface area of the workpiece 1 bottom face after forming the chamfered portion is not less than ½ of the surface area prior to chamfering. There is a concern of the workpiece becoming unstable on the anvil if excessive chamfering is performed.

The reason for forming the chamfered portion 9 to the bottom face side is that there is a concern of the temperature of the workpiece 1 dropping due to the bottom face of the workpiece 1 contacting the anvil 4. In particular, due to the temperature of the workpiece readily dropping at the end portion 8, there is a possibility of cracks developing in the workpiece from the end portion 8 during hot upset forging when the chamfered portion 9 is not formed as a preventative measure. When the chamfered portion is less than 5 mm, then there is little advantageous effect from the beveling, and moreover beveling beyond 30 mm is merely detrimental to yield. It is more preferable to form the chamfered portion 9 to the upper face of the workpiece as well. Note that a Ni-based super heat-resistant alloy, such as Alloy 718, or a Ti alloy, is particularly preferable as a substance for forming the chamfered portion.

Explanation follows regarding an example of composition of a mold employed in the invention.

A substance having a combination of both strength and toughness is preferable for the mold used in hot upset forging used in the invention, and a steel alloy of the following composition may be used.

Note that the composition is shown as mass %.

C: from 0.3% to 0.6%

C has functions of: dissolving as a solid-state solution into base metal during quenching heating to impart a necessary quenching hardness; forming carbides and precipitating during tempering to impart softening resistance and high temperature strength in tempering; forming residual carbides to impart wear resistance at high temperature; and preventing coarser graining of grains during quenching heating. From 0.3% to 0.6% is therefore preferable.

Si: 1.2% or less

Si is added as a deoxidizer during melting. However, adding a large quantity thereof reduces toughness. 1.2% or less is therefore preferable.

Mn: 1.0% or less

Mn is added as a deoxidizer and a desulfurizer during melting. However, adding a large quantity thereof reduces toughness. 1.0% or less is therefore preferable.

Ni: 2.0% or less

Ni enhances quenchability, and improves toughness. However, including a large quantity thereof lowers the transformation temperature, and reduces the high temperature strength. 2.0% or less of Ni is therefore preferable.

Cr: from 1.0% to 5.5%

Cr enhances quenchability, and improves toughness. However, including a large quantity thereof reduces toughness. From 1.0% to 5.5% is therefore preferable.

Mo: from 0.2% to 1.6%

Mo enhances quenchability. Moreover, fine carbides are formed by tempering, and high temperature tensile strength is increased. A range of from 0.2% to 1.6% is therefore preferable.

V: from 0.1% to 1.1%

V lowers grain size, and improves toughness. Moreover, high hardness carbonitrides are formed by tempering, and tensile strength is increased. However, including a large quantity thereof reduces toughness. A range of from 0.1% to 1.1% is therefore preferable.

The remaining portion other than the above is preferably configured by Fe and impurities.

EXAMPLES

Example 1

Material for a workpiece was produced by hot forging an alloy equivalent to Alloy 718 from four directions. The workpiece material was machined to obtain a circular column shaped hot upset workpiece 1 with diameter (d) of 100 mm and height (h) of 420 mm. A chamfered portion 9 having a curved face with a radius of 20 mm was formed to the upper face and the bottom face of the workpiece 1.

A hot upset forging mold 2 such as that illustrated in FIG. 1, formed with a circular shaped insertion hole, a tapered portion 3 formed at the insertion hole, and an insertion hole height (H) of 440 mm, was employed as a mold for upset forging of the workpiece 1. The angle of the taper portion 3 was set at 1°, and the maximum inner diameter (D) of the circular shaped insertion hole formed to the mold 2 was 110 mm. The composition of the mold 2 was as shown in Table 1. Note that the cross-sectional shape (along A-A' in FIG. 1) of the workpiece was circular.

TABLE 1

| C | Si | Mn | V | Cr | Ni | Mo | (mass %) Remaining Portion |
|---|---|---|---|---|---|---|---|
| 0.5 | 0.3 | 0.9 | 0.2 | 1.3 | 1.8 | 0.4 | Fe and impurities |

Upset forging was performed by hot-working using the workpiece 1 and the mold 2 described above. The workpiece 1 was heated to 1000° C. The forging material on which the upset forging described in the present example had been performed was to be used as a material for a gas turbine compressor with a final shape of a circular disk shape.

In the upset forging, in order to obtain a forged material (intermediate material 5), the workpiece 1 was inserted into the insertion hole of the mold 2 set on an anvil 4, and upset forging was performed a first time in the workpiece height direction. The intermediate material 5 obtained had a bottom face diameter (dm) of 100 mm, a largest diameter (dlm) of 110 mm, and a height (hm) of 347 mm.

At this point in time, since the height/diameter of the forged material exceeded 3, the forged intermediate material 5 obtained was employed as a new workpiece, re-heated to 1000° C., and a second time of upset forging was performed by hot-working. An intermediate material upset-forging mold 6 used at this point was formed with a circular shaped insertion hole, with a taper at angle of 2° formed at the insertion hole, such as illustrated in FIG. 5, an insertion hole height (Hm) of 400 mm, and an insertion hole maximum inner diameter (Dm) of 120 mm.

Figure 6:
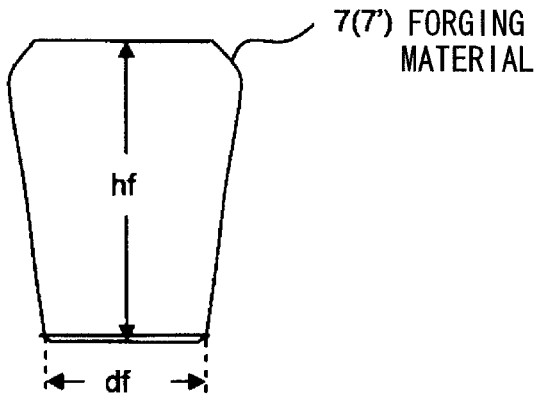
FIG. 6 is a schematic view illustrating an example of a final material shape.

Forging material 7 after performing the second time of upset forging on the intermediate material 5 at a hot-working temperature had a bottom face diameter (df) of 114 mm and a height (hf) of 291 mm, as illustrated in FIG. 6, thereby satisfying hf/df of 3 or less.

Buckling occurred neither during the first time of upset forging of the workpiece 1, nor during the second time of upset forging of the intermediate material 5, and no forging defects were observed in the obtained forging stock 7.

When stamp forging was performed using the forging material 7 described above, producing material for a gas turbine compressor, the shape of the forging material 7 was uniform with good dimensional precision, enabling material with good reproducibility and high dimensional precision to be formed. Moreover, there were few forging defects during the stamp forging, meaning that forming processing could be performed efficiently.

Example 2

Material for a workpiece was machined using the same method as Example 1 to obtain a circular column shaped hot upset workpiece 1' with a diameter (d) of 90 mm, smaller than that of Example 1, and a height (h) of 420 mm, the same as that of Example 1. Chamfered portions 9 were formed as curved faces of 15 mm radius to the upper face and the bottom face of the workpiece 1.

A first time of upset forging was performed on the obtained workpiece 1' using the same method and the same mold 2 as Example 1. However, since the largest diameter (dl) of the workpiece 1' was smaller than that of Example 1, the workpiece 1' was disposed almost exactly at the center of the insertion hole provided to the mold 2. An obtained intermediate material 5' had a bottom face diameter (dm) of 90 mm, a largest diameter (dlm) of 105 mm, and a height (hm) of 320 mm.

Next, a second time of upset forging was performed on the intermediate material 5' using the same method and the same intermediate material upset-forging mold 6 as Example 1.

Obtained forging stock 7' had a bottom face diameter (df) of 115 mm and a height (hf) of 270 mm, thereby satisfying hf/df of 3 or less.

Buckling occurred neither during the first time of upset forging of the workpiece 1', nor during the second time of upset forging of the intermediate material 5', and no forging defects were observed in the obtained forging stock 7'.

Comparative Example

Material for a workpiece was machined using the same method as Example 1, to obtain a circular column shaped hot upset workpiece 1" with a diameter (d) of 70 mm, even smaller than that of Example 2, and a height (h) of 420 mm, that same as that of Example 1 and Example 2. Chamfered portions 9 were formed as curved faces of 5 mm radius to the upper face and the bottom face of the workpiece 1. In the Comparative Example, the relationship $D \leq dl \times 1.5$ was not satisfied.

When the first time of upset forging was performed on the obtained workpiece 1" using the same method and the same mold 2 as Example 1, buckling of the workpiece 1" occurred, and so upset forging for the second time onwards was therefore abandoned.

EXPLANATION OF THE REFERENCE NUMERALS

| | |
|---|---|
| 1, 1', 1" | workpiece |
| 2 | mold |
| 3 | tapered portion of mold |
| 4 | anvil |
| 5, 5' | intermediate material |
| 6 | intermediate material upset-forging mold |
| 7, 7' | forging material |
| 8 | end portion |
| 9 | chamfered portion |
| H | mold height |
| D | maximum inner diameter of insertion hole |
| h | workpiece height |
| d | bottom face diameter of workpiece |

The invention claimed is:

1. A hot upset forging method comprising:

inserting a workpiece consisting of an alloy, with a bottom face diameter d and a height h satisfying h/d>3, into an insertion hole provided passing through a mold of a height H disposed on an anvil; and increasing a diameter of the workpiece while decreasing the height of the workpiece to form a forged material, wherein the mold satisfies the following relationships (1) to (3):

(1) a shape of the insertion hole and a cross-sectional shape of the workpiece are substantially similar shapes;

(2) the height h of the workpiece≤the height H of the mold; and (3) a largest diameter dl of the workpiece, and a maximum inner diameter D of the insertion hole, in a height range of the workpiece, satisfy $dl<D\leq dl\times 1.5$, and wherein a chamfered portion is formed at from 5 mm to 30 mm from an end portion of the bottom face of the workpiece, and wherein a tapered portion, having an increasing diameter in a height direction such that an angle of the tapered portion is 3° or less from vertical, is formed at the insertion hole provided at the mold.

2. The hot upset forging method of claim 1, wherein, after the mold is replaced with another mold that satisfies the relationships of (1) to (3), hot upset forging is performed a further n times, wherein n is an integer of 1 or more, using the forged material obtained in claim 1 as a new workpiece, to obtain a final forged material with a bottom face diameter df and a height hf satisfying $hf/df\leq 3$.

* * * * *